US006131841A

United States Patent [19]

Jang

[11] Patent Number: 6,131,841

[45] Date of Patent: Oct. 17, 2000

[54] YARN SUPPLY APPARATUS FOR TEXTILE MACHINES

[76] Inventor: Byung In Jang, 289-18, 3-Dong, Seongsu2-GA, Seongdong-ku, Seoul, Rep. of Korea, 133-120

[21] Appl. No.: 09/250,248

[22] Filed: Feb. 16, 1999

[30] Foreign Application Priority Data

Mar. 2, 1998 [KR] Rep. of Korea ..... 98-6758

[51] Int. Cl.[7] ..... B65H 59/22

[52] U.S. Cl. ..... 242/365.6; 242/419.5; 242/150 R

[58] Field of Search ..... 242/150 M, 150 R, 242/365.6, 419.5; B65H 59/22

[56] References Cited

U.S. PATENT DOCUMENTS

| | | | |
|---|---|---|---|
| 2,029,943 | 2/1936 | Reiners et al. | 242/150 R |
| 2,661,913 | 12/1953 | Heizer et al. | 242/150 R |
| 2,843,336 | 1/1958 | Herbst | 242/150 R |
| 2,955,775 | 10/1960 | Johnson | 242/150 R |
| 4,056,239 | 11/1977 | Fecker et al. . | |
| 4,572,459 | 2/1986 | Kamp et al. | 242/150 R |
| 4,725,015 | 2/1988 | Zitzen | 242/150 R |
| 4,793,565 | 12/1988 | Fecker . | |
| 5,191,847 | 3/1993 | Kojima et al. | 242/150 R X |
| 5,655,721 | 8/1997 | Matsuoka | 242/150 R |

*Primary Examiner*—Donald P. Walsh
*Assistant Examiner*—Collin A. Webb

[57] ABSTRACT

A yarn supply apparatus, particularly for textile machines, includes a rotary pulley over a holder body and a yarn supply reel under the holder body both of which are secured to a rotary shaft so that a yarn passed through in the order of a yarn guiding eyelet and a disk is wound around a number of elongated metallic rods located between two flanges to form a plurality of loops of yarn windings. The yarn stored on the metallic rods of the yarn supply reel is continuously let off from the lower side thereof to a let off guiding member. The yarn supply apparatus further includes a driving part having a cover for a holder body and a hollow portion in the interior thereof. A first pulley is rotated around a first shaft secured to the holder body and a second pulley is driven by the rotating power of the first pulley. A disk part is located under the holder body and secured to the second pulley shaft and several idle disks sited upside of disk.

13 Claims, 8 Drawing Sheets

YARN SUPPLY APPARATUS FOR TEXTILE MACHINES

BACKGROUND OF THE INVENTION

1. Field of the Invention

This invention relates to a yarn supply apparatus, particularly for textile machines, which can supply a yarn wound around a cheese to a needle under invariable tension by rotating disks so that the yarn can graze past the disks when weaving or knitting textiles using a weaving machine or a knitting machine.

2. Disclosure of Related Art

Generally, to produce textiles having uniform evenness and smoothness using a weaving machine or a knitting machine, a yarn should be supplied to a means of the subsequent process, particularly a needle knitting textiles under invariable tension and also different substances such as dust and the like should be prevented from adhering to the yarn.

A conventional yarn supply apparatus shown in FIG. 1 has an attachment part (508) to assemble it on the upper part of a knitting machine, and a rotary pully (500) over the holder body (50) and a yarn supply reel (501) under the holder body (50) which are constituent of said yarn supply apparatus are coaxially secured to the rotary shaft (503) together.

Said yarn supply reel (501) is embodied in the form of a cylindrical cage having a number of elongated metallic rods (501*a*) located between two flanges (505), (507), thereby the yarn passed in the order of a yarn guiding eyelet (100) and a disk (506) is wound around said metallic rods (501*a*) to form a plurality of loops of yarn windings. The yarn stored around said metallic rods (501*a*) of the yarn supply reel (501) is continuously let off from the lower side thereof to a let off guiding member (504), the first let off eyelet (504*a*) and the second let off eyelet (504*b*).

Said yarn which is let off to the lower side of the yarn supply reel (501) is let off without trembling since it is delivered to a needle of a textile knitting part (not shown) in condition of non-contact with the lower flange (507) of the yarn supply reel (501).

As another conventional art, the yarn supply apparatus described in Korea Patent Registration No.29468 which is the corresponding Korean Patent application of U.S. Pat. No. 4,793,565 has a storage drum having a drum shaft, a drum body, and a plurality of elongated yarn support elements distributed circumferentially around the drum shaft at a given radial distance therefrom and extending substantially in the direction of the drum shaft; each of the yarn support elements being in the form of a narrow yoke secured at both ends to the drum body and having, on a yarn supply side of the drum body, a first portion tapering radially inward toward the drum shaft to form a run-on incline for oncoming yarn and, adjoining this first portion, a second portion that at least in some segments is substantially straight and that forms a yarn support region for a plurality of loops of one yarn winding, wherein the first and second portions of all the yokes are, respectively, each located on common imaginary rotational bodies that are coaxial with the drum shaft; yarn delivery means for feeding yarn to the yarn supply side of the drum body; yarn run-off for removing yarn tangentially from a rim on a yarn run-off side of the drum body to a location positioned laterally of the drum shaft direction; a drive means coupled to the storage drum for attaining a relative rotation between the storage drum and the yarn delivery means and yarn run-off means; the drum body having the yarn supply side located toward one end of the drum shaft, a yarn run-off side toward the other end of the drum shaft including the rim which is a radially protruding, circular, continuous yarn run-off rim extending further axially from the yarn supply side than does the substantially straight second portion of the yakes, and means on the yarn run-off side for preventing accumulation on the yarn run-off side of fiber parts shed by the yarn, including means for defining a circumferential surface which is engaged by the yarn and extends, in the drum shaft direction, toward the yarn supply side from the run-off rim, and is radially inwardly inclined toward the drum shaft, the surface being coaxial with and coupled to the drum shaft and continuous in the circumferential direction, at least in regions located between adjacent yokes, at least part of the surface being, in the drum shaft direction, between the yarn supply side and the location to which the yarn is removed, the yokes entering the surface to form a substantially smooth transition zone therebetween; whereby the circumferential surface on the yarn run-off side of the storage drum is axially stripped continuously by yarn running off the yarn run-off rim to clear the drum of fiber parts shed by the yarn.

However, the yarn supply apparatus of the above invention has problems that magnets should be assembled in disks in order to invariably keep tension of a yarn using the frictional force occurring between disks attached by magnetic force and a yarn passing through the disks in the process of supplying a yarn to a storage drum and that a portion of yarn wears because disks are rotated by frictional force and thus the dust such as yarn ends is stacked on the surface of the yarn supply apparatus.

Further, it is a problem that disks of the above invention protrude toward one side of a holder body so that dust and the like adhere on the disks and thereby the yarn adhered different substances such as dust are supplied to a needle, thereby hindering the subsequent process.

SUMMARY OF THE INVENTION

The present invention is intended to solve the faults of conventional yarn supply apparatuses and the object of the present invention is to provide a yarn supply apparatus which can minimize the frictional force between disks and a yarn in the process of supplying a yarn to a yarn supply reel.

To achieve this object, a yarn supply apparatus for textile machines of the present invention includes of a cover putting an installation part of the holder body on, a driving part composed of the first pulley and the second pulley which are rotated around a rotary shaft turning a yarn supply reel by driving of rotary pulley and a disk part having several idle disks.

BRIEF DESCRIPTION OF THE ATTACHED DRAWINGS

The accompanying drawings, which are included to provide a further understanding of the present invention and are incorporated in and constitute a part of this specification, illustrate the preferred embodiments of the present invention and together with the description serve to explain the principles of the invention.

DETAILED DESCRIPTION OF THE PREFERRED EMBODIMENT

Figure 1:
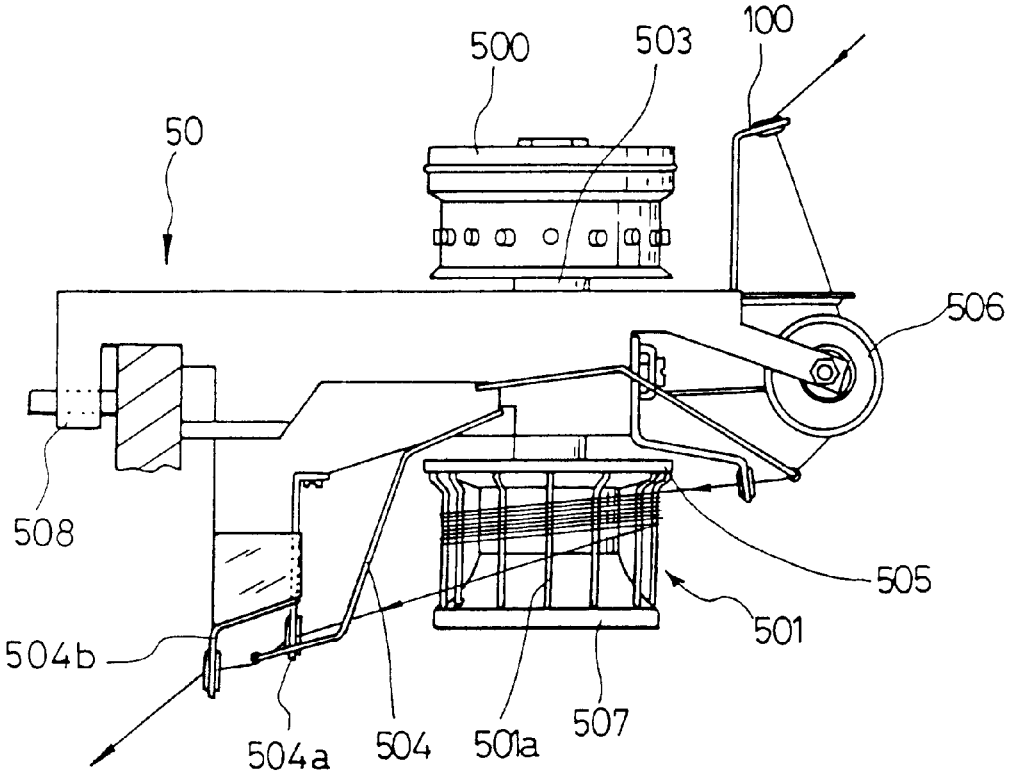
FIG. 1 PRIOR ART
FIG. 1 is a side view showing a conventional yarn supply apparatus.

Referring to the drawings attached herewith, a preferred embodiment of the present invention shall be described in detail.

Figure 2:
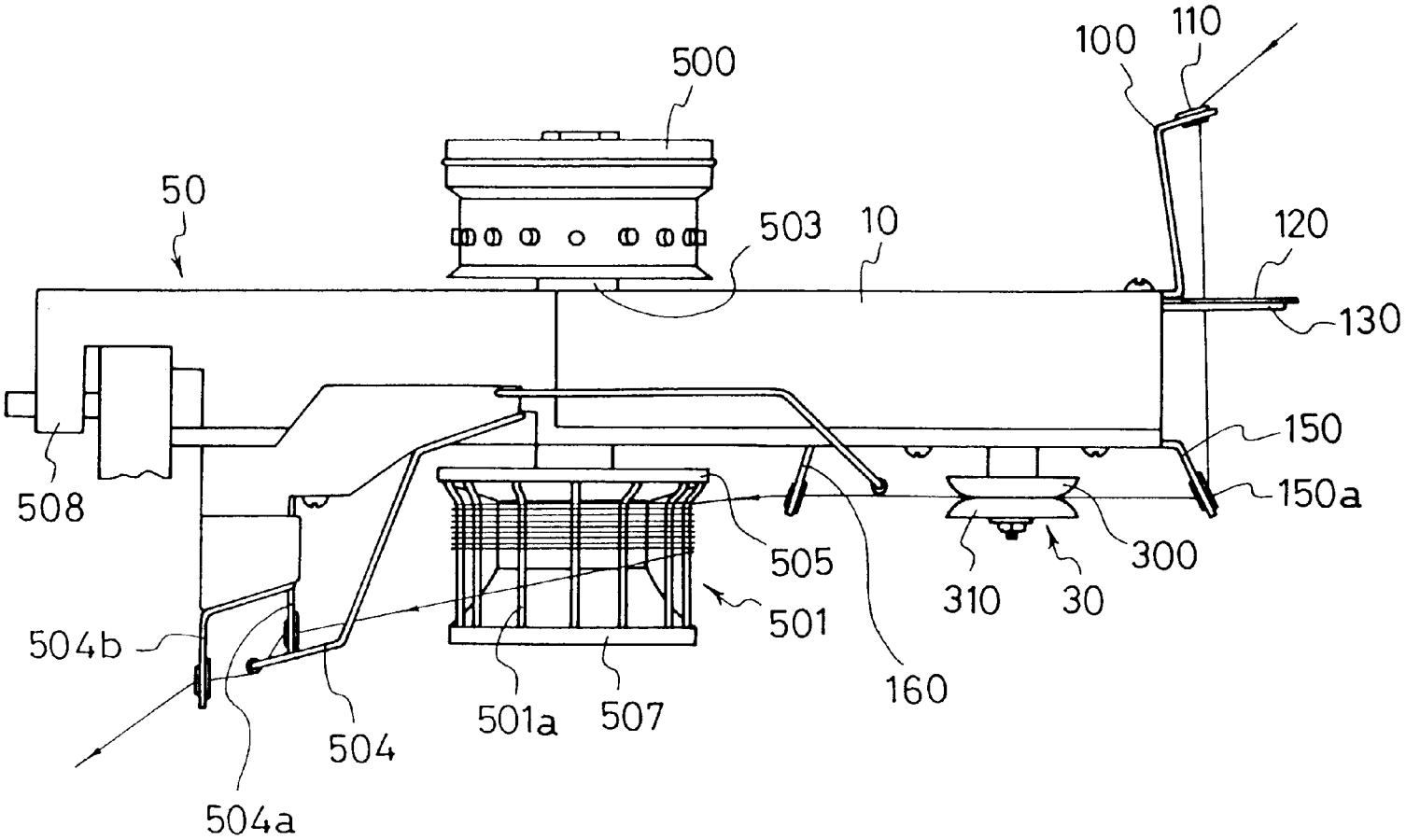
FIG. 2 is a side view showing a yarn supply apparatus of the present invention.
Figure 3:
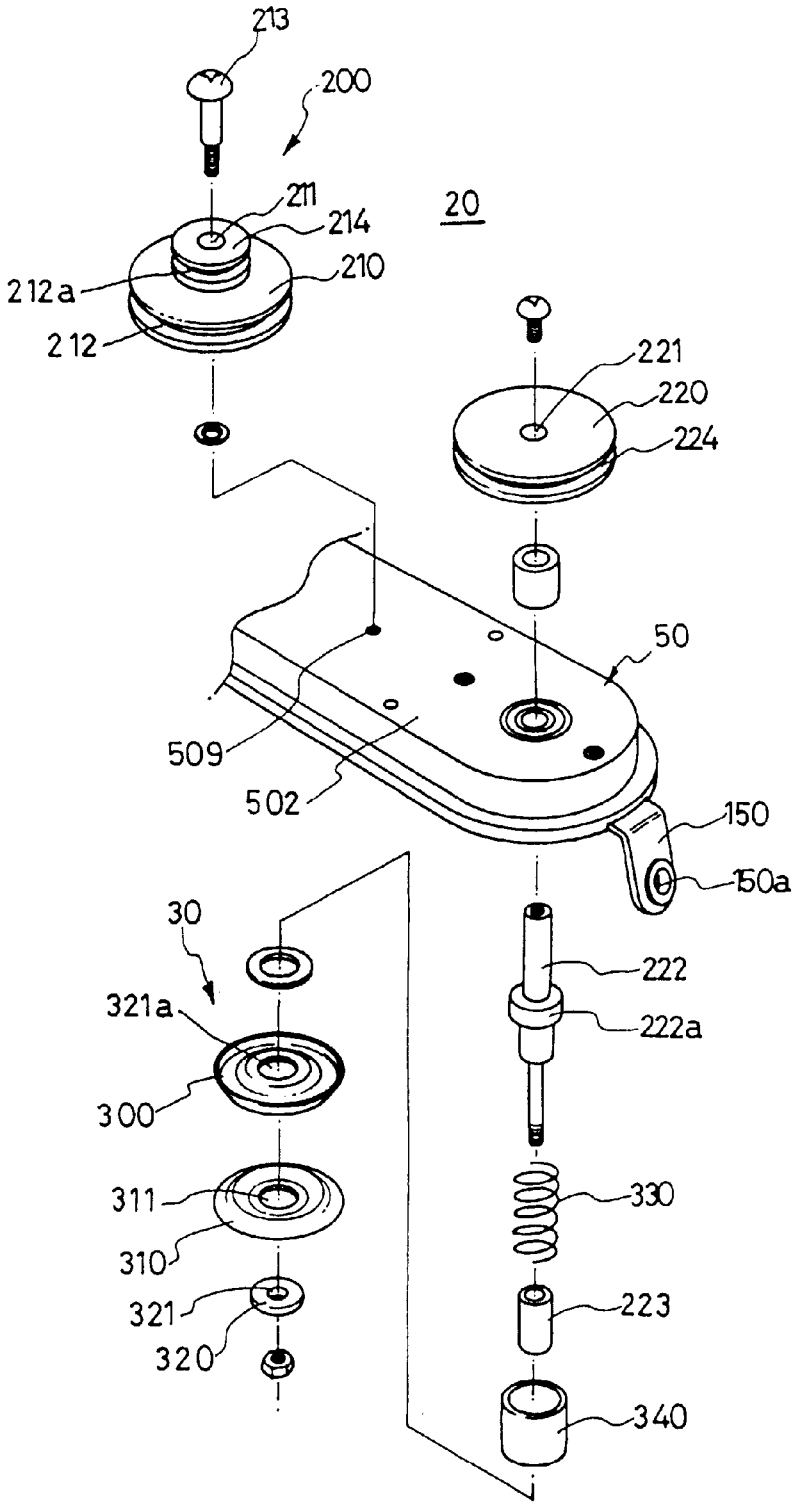
FIG. 3 is an exploded perspective view showing a disk part and a driving part of a yarn supply apparatus of the present invention.
Figure 4:
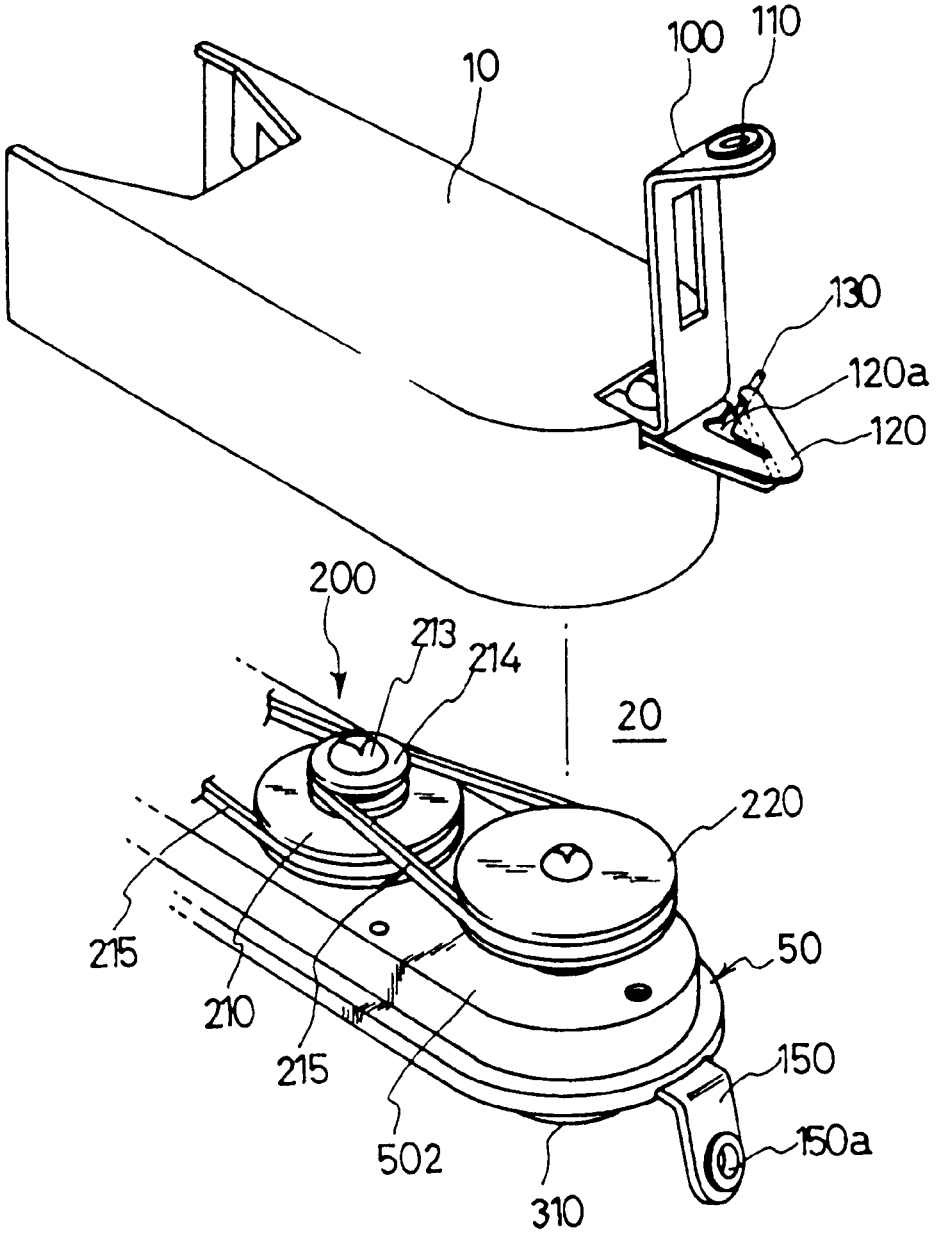
FIG. 4 is a perspective view showing a combined state of a disk part and a driving part of a yarn supply apparatus of the present invention.
Figure 5:
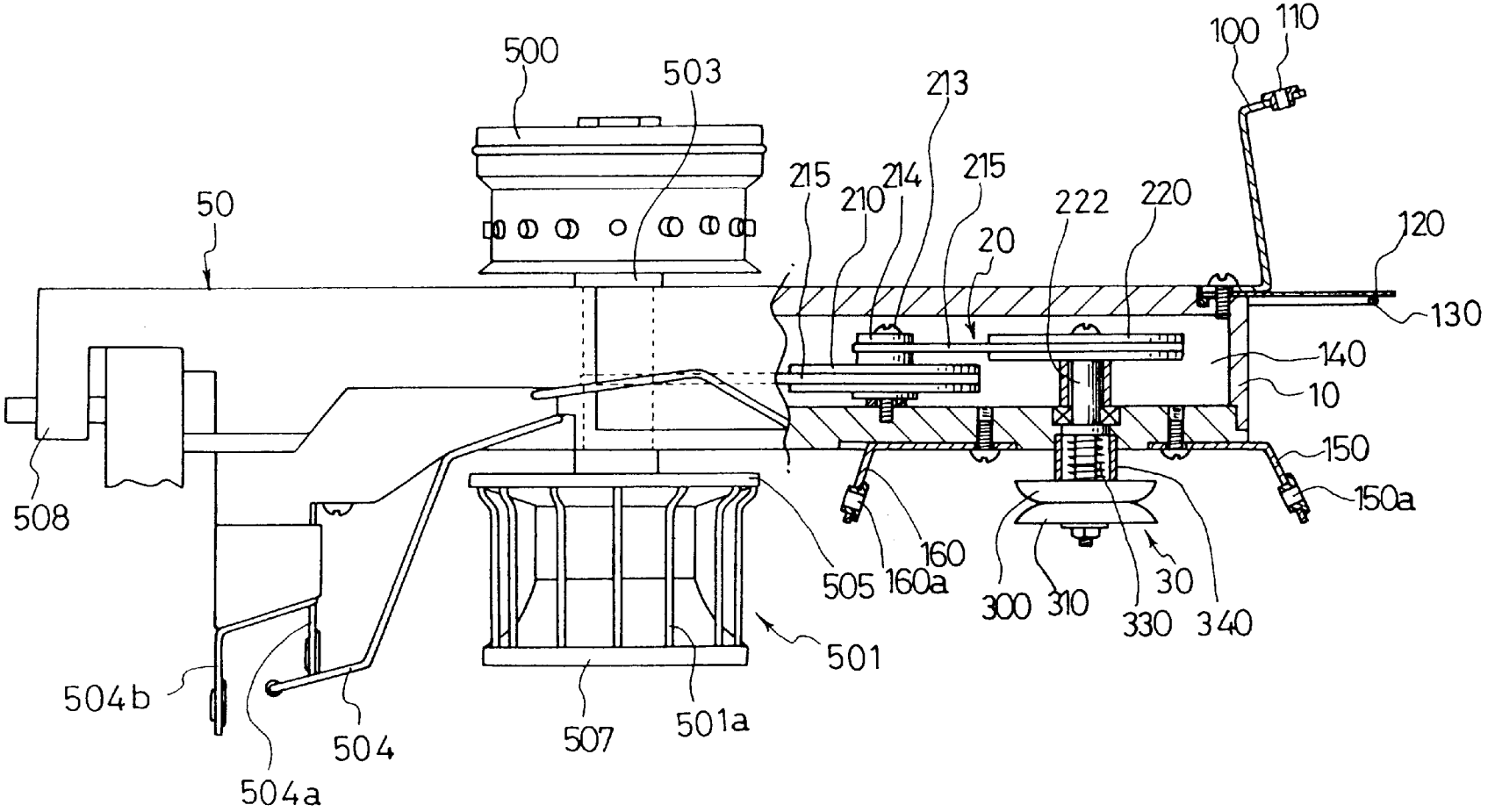
FIG. 5 is a partially exploded sectional view of a disk part and a driving part of a yarn supply apparatus of the present invention.
Figure 6:
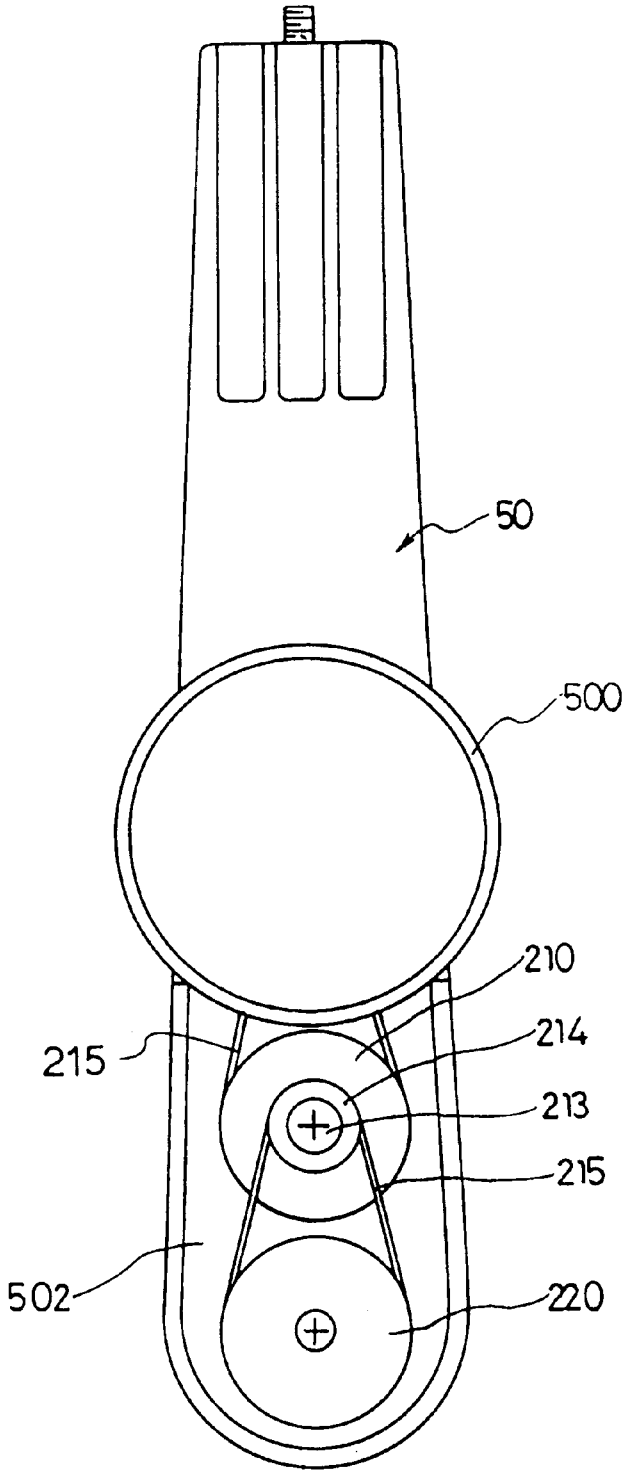
FIG. 6 is a plan view showing a driving part of a yarn supply apparatus of the present invention.
Figure 7:
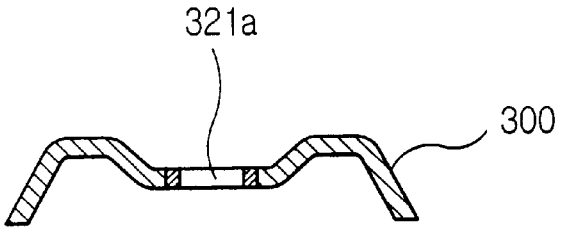
FIG. 7 is a cross sectional view showing a disk of the present invention.

FIG. 2 is a side view showing a yarn supply apparatus of the present invention, FIG. 3 is an exploded perspective view showing a disk part and a driving part of a yarn supply apparatus of the present invention and FIG. 4 is a perspective view showing a combined state of a disk part and a driving part of a yarn supply apparatus of the present invention. To help better understanding of features in this invention, the same members as the constituent of the conventional yarn supply apparatus shown in FIG. 1 are represented as same numerals.

According to the present invention, a yarn supply apparatus for a textile machine includes a rotary pulley 500 over a holder body 50 and a yarn supply reel 501 under the holder body 50 both of which are secured to a rotary shaft 503 so that a yarn passed through in the order of a yarn guiding eyelet 100 and a disk 506 is wound around a number of elongated metallic rods 501*a* located between two flanges 505, 507 to form a plurality of loops of yarn windings and then the yarn stored on the metallic rods 501*a* of the yarn supply reel 501 is continuously let off from the lower side thereof to a let off guiding member 504, The yarn supply apparatus for a textile machine further includes a driving part 20 having a cover 10 over a part of a holder body 50 and having hollow portion 140 in the interior thereof, a first pulley 210 to be rotated around a rotary shaft 503 secured to a holder body 50 and a second pulley 220 to be driven by means of the rotating power of the first pulley 210; and a disk part 30 having a disk 310 which is located under the holder body 50 and secured to the second pulley shaft 222 and several idle disks 300 sited upside of the disk 310.

The cover 10 which is assembled with the holder body 50 has an opened bottom and a hollow portion 140 at its interior, and one of both sides thereof is opened and the other side is roundly closed so as to have the identical width with that of the holder body 50. Also a yarn guiding eyelet 100 and a yarn guiding member 120 are installed on top end of the cover 10.

The hollow portion 140 covers a driving part 20 for protection.

The yarn guiding eyelet 100 is folded twice so as to form a yarn feeding hole 110 on one end and a screw hole on the other end for fastening the yarn guiding eyelet 100 on the cover 10 (FIG. 2).

The yarn feeding hole 110 of the yarn guiding eyelet 100 assembles with a ring made of ceramics on the inside circumference thereof so as to prevent the yarn feeding hole 110 from wearing due to friction occurring between a yarn and the yarn feeding hole 110 in progressing of the yarn.

A screw hole is formed in one side of the yarn guiding member 120 so as to fasten it to the holder cover 10, with the screw hole sited under the yarn guiding eyelet 100 and thus a folded yarn guiding groove 120*a* in the other side is formed as known to all. The yarn guiding member 120 permits yarn to pass through the yarn guiding groove 120*a* without any friction with the yarn guiding member 120 in order to minimize frictional force which may be occurred between a yarn and itself in the procedure of letting off said yarn delivered from the yarn feeding hole 110 of the yarn guiding eyelet 100 to a disk part (30).

A yarn guiding bar 130 is installed between the yarn guiding member 120 and the cover 10, one end of which is further projected than the side of the yarn guiding member 120 so as to easily guide the yarn to the yarn guiding groove 120*a*.

The driving part 20 is assembled on the top surface of the installation part 502 of the holder body 50 and is protected by the hollow portion 140 of the cover 10. The driving part 20 includes the first pulley 210 to which driving power is delivered by a belt 215 rotated around the rotary shaft 503 through which a rotary pulley 500 and yarn supply reel 501 are sited over and under the holder body 50 and the second pulley 220 to be driven by the driving power from the first pulley part 200 of the first pulley 210 by means of the belt 215.

The first pulley part (200) includes the first pulley 210, an assistant pulley 214 having the first pulley hole 211 in center thereof and a pulley shaft 213.

A belt groover 212 is formed in the outside circumference of the first pulley 210 and a belt first belt 215 is wound around the belt groove 212 and accordingly, the driving force of the rotary shaft 503 is delivered to the first pulley 210.

The diameter of the outside circumference of the assistant pulley 214 is smaller than that of the first pulley 210 and also has the first pulley hole 210 in a center of the assistant pulley 214. An assistant pulley 214 is secured on the holder body 50 forceably inserting the pulley shaft 213 into the first pulley hole 211 after situating the assistant pulley 214 on the first pulley 210, whereby the assistant pulley 214 synchronously rotates with the first pulley 210.

In the outside circumference of the assistant pulley 214 a belt groove 212*a* wound with a belt 215' is formed so that the driving force of the assistant pulley 214 is delivered to the second pulley 220.

One end of the pulley shaft 213 is assembled with a pulley assembly hole 509 punched on the installation part 502 of the holder body 50 in the manner of being able to idle.

The second pulley hole 221 and a belt groove 224 are respectively formed in the center and on the outside circumference of the second pulley 220 and the second pulley 220 is assembled upside of the holder body 50. The second pulley shaft 222 is combined in the lower side of the second pulley 220 to be engaged with a disk part 30. The belt groove 212*a* of the assistant pulley 214 and the belt groove 224 of the second pulley 220 are connected with the belt 215 thereby delivering a driving force to the second pulley 220 while the rotating speed of the rotary pulley 500 is reduced, because the outer diameter of the assistant pulley 214 is smaller than that of the second pulley 220.

The second pulley shaft 222 is forceably inserted into the second pulley hole 221 whereby the second pulley shaft 222 is synchronously rotated with the rotation of the second pulley 220.

The second pulley shaft 222 is multistory and in the lower part thereof a tube 223 is inserted in order to protect the pulley shaft 222. It is desirable that the tube 223 is made of ceramics which does not easily wear away.

Figure 9:
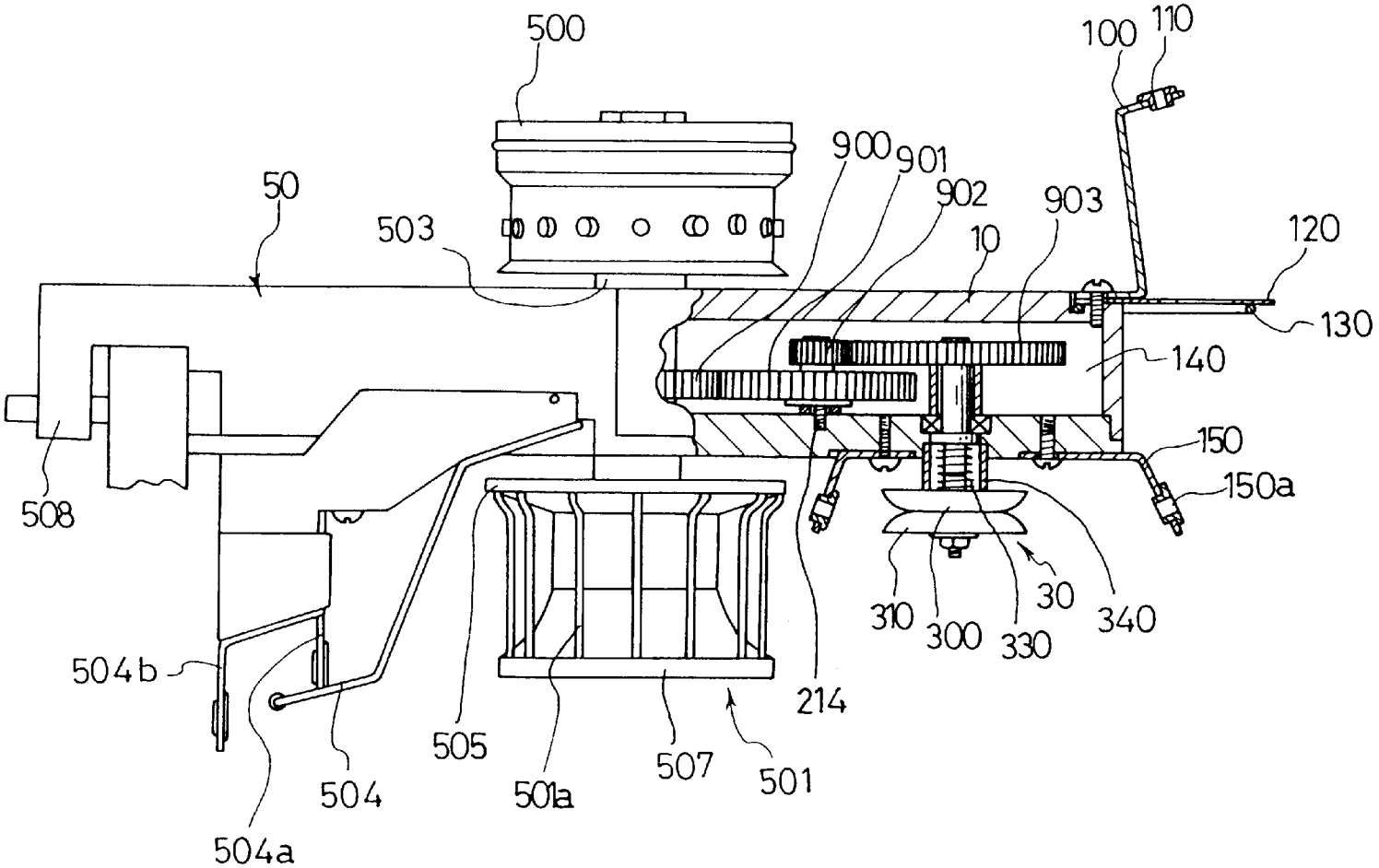
FIG. 9 is a partially exploded sectional view of a disk part and a driving part showing another embodiment according to the present invention.

Another embodiment of a driving part 20 as shown in FIG. 9. forms teeth on the outside circumferences of a first pulley 901 and a rotary shaft 900 which is in contact with the first pulley 901 so as to engage each other and also forms teeth on the outside circumferences of an assistant pulley 902 sited on the first pulley 901 and a second pulley 903 to engage each other.

Accordingly, the driving power of the rotary shaft 900 is delivered to the second pulley 903 by the engagement with the first pulley 901 and a rotary shaft 900 and the engagement with the assistant pulley (902) assembled on the first pulley 901 and a second pulley 903.

A disk part 30 is sited under the installation part 502 of the holder body 50 and consists of a disk 310 secured to the second pulley shaft 222, an idle disk 300 upside of said disk 310, a spring 330 and a spring housing 340.

A fixing member hole 311 is punched in the center of the disk 310 and a fixing member (320) is assembled to said fixing member hole 311.

The second pulley hole 321 is punched in a center of the fixing member 320 and the second pulley shaft 222 is inserted thereinto.

Also, the second pulley hole 321*a* in center of the idle disk 300 is punched and assembled to the second pulley shaft 222 to run idle.

The spring 330 is sited between the idle disk 300 and a flange 222*a* of the second pulley shaft 222 thereby keeping the gap between the idle disk 300 and the disk 310 by the spring 330 uniform.

The spring housing 340 is sited over the outside of the spring 330 so that it protects the spring 330 and it prevents different substances such as dust from entering into the spring 330 whereby the spring 330 is able to have a regular elastic force.

Figure 8:
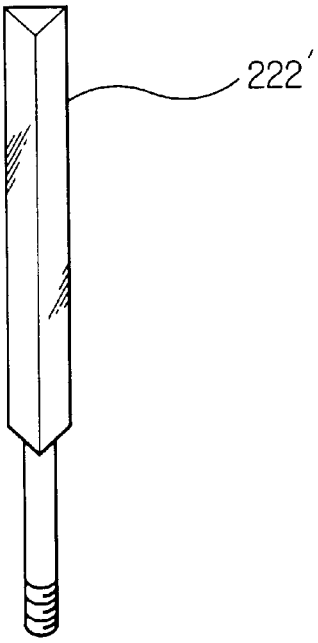
FIG. 8 is a perspective view showing another embodiment of a pulley shaft according to this invention.

As directed in FIG. 8, in another embodiment of the second pulley shaft 222 as shown in FIG. 8 shows that the second pulley shaft 222 may be substituted with pulley shaft 222', and the cross-section of the upside among two stories is made to a polygon such as trilateral.

The second yarn guiding eyelet 150 is installed downward by at one end of the holder body 50 in order that the yarn feeding hole 150*a* connected therein is positioned between said disk 310 and the idle disk 300. Therefore the friction occurring when a yarn passes through the idle disk 300 and disk 310 after the yarn passes through the yarn feeding hole 110 of the yarn guiding eyelet 100 which is installed on the cover 10 is considerably reduced.

Also, the third yarn guiding eyelet 160 is installed on the bottom of the holder body 50. In this moment, the assembling site of the third yarn guiding eyelet 160 is selected to be positioned between the disk part (30) and the yarn supply reel 501 and the yarn feeding hole 160*a* guides the yarn supplied from the disk part 30 to the upside of the yarn supply reel 501 whereby a plurality of loops of yarn windings forms around the yarn supply reel 501 forms.

The first let off eyelet 504*a* and the second let off eyelet 504*b* guiding a yarn of the yarn supply reel 501 to the following textile producing process, particularly knitting portion are provided, and a yarn feeding hole of the first let off eyelet 504*a* is suitably installed so that it should be the same height as the upside of the lower flange 507 in the yarn supply reel 501 in order to smoothly let off the yarn without any friction with the lower flange 507 of the yarn supply reel 501.

The operation of the present invention is as follows.

After a yarn wound around a cheese is supplied to a yarn feeding hole 110 of a yarn guiding eyelet 100, the yarn passes through in the order of a yarn guiding groove 120*a* of the yarn guiding member 120, a yarn guiding eyelet 150 assembled on the bottom of a holder body 50 and the interspace between a disk 310 and an idle disk 300. And then the yarn is wound on metallic rods 501*a* of the yarn supply reel 501 to form a plurality of loops of yarn windings and delivered to a needle of the following knitting portion. In this yarn delivery proceeding, a rotary pulley 500 is rotated by a timing belt transmitting the moving force of a motor and a yarn supply reel 501 and a rotary shaft 503 secured to the rotary pulley 500 are also rotated.

The first pulley 210 which is connected with the rotary shaft 503 by a belt 215 is rotated by the rotation of the rotary shaft 503 and an assistant pulley 214 engaged with a pulley shaft 213 on the first pulley 210 is synchronously moved with the first pulley 210.

Because the diameter of the assistant pulley 214 is smaller than that of the first pulley 210 and the diameter of the second pulley 220 is larger than that of the assistant pulley 214, the rotative speed is reduced and the second rotary shaft 222 is rotated under the reduced rotative speed. Also, a disk 310 assembled to the second rotary shaft 222 is rotated by the rotation of the second pulley shaft 222.

By the rotation of said disk 310, an idle disk 300 sited on the disk 310 begins to run idle when contacting with the disk 310. Accordingly, the yarn passing through the interspace between the disk 310 and the idle disk 300 is supplied to the yarn supply reel 501 under the minimized friction.

The yarn supply apparatus for textile machines of the present invention has the advantage of minimizing the friction to be induced by passing a yarn through the interspace between disks which is being rotated in the proceeding of supplying a yarn to a yarn supply reel.

Further advantage of the yarn supply apparatus for textile machines of the present invention is to assemble disks on the bottom of a holder body in order to prevent dust from adhering thereto whereby a clean yarn without any dust can be supplied to a needle of the following knitting portion.

The invention being thus described, it will be understood that variations and modifications may be made to the invention without altering the scope of the invention. All such modifications are intended to be included within the scope of the following claims.

What is claimed is:

1. A yarn supply apparatus for a textile machine having a rotary pulley over a holder body and a yarn supply reel under the holder body, both of the rotary pulley and the yarn supply reel being secured to a rotary shaft, so that a yarn passing through a yarn guiding eyelet and a disk, respectively, is wound around a number of elongated metallic rods located between two flanges to form a plurality of loops of yarn windings and the yarn stored on said metallic rods of the yarn supply reel is continuously let off from the lower side thereof to a let off guiding member said yarn supply apparatus comprising:

a cover removably mounted to said holder body so as to form an extension thereof, said cover having an upper surface coextensive with an upper surface of said holder body said upper surface facing away from said holder body and, being free of a bottom surface, and having a hollow portion at an interior thereof;

a first pulley rotatable around a first pulley shaft secured to said holder body, said first pulley shaft including an assistant pulley member thereon and rotatable with said first pulley;

a second pulley rotatable around a second pulley shaft mounted to said holder body;

a first engagement device formed around said rotary shaft and said first pulley, whereby rotation of said rotary shaft imparts a drive to said first pulley;

a second engagement device formed around said assistant pulley and said second pulley, whereby rotation of said first pulley imparts a drive to said second pulley; and a disk part having a first disk positioned under said holder body and secured to said second pulley shaft and an idle disk located facing said first disk, wherein said cover member surrounds each of said first pulley, said second pulley, said engagement devices, and said shafts.

2. The yarn supply apparatus for a textile machine according to claim 1, wherein said cover includes an open bottom and hollow portion at the interior thereof, and one of both ends thereof is open and the other end is closed so as to have the identical width of said holder body, said cover seating on said holder body so as to form an enclosed space.

3. The yarn supply apparatus for a textile machine according to claim 1, wherein a yarn guiding eyelet and a yarn guiding member are installed on an exterior of said cover.

4. The yarn supply apparatus for a textile machine according to claim 1, wherein one end of said first pulley shaft is assembled with a pulley assembly hole punched on an upper surface of said holder body in the manner of being able to idle.

5. The yarn supply apparatus for a textile machine according to claim 1, wherein said engagement devices include teeth formed around each of said first pulley, second pulley and assistant pulley in their outside circumferences so as to engage each other.

6. The yarn supply apparatus for a textile machine according to claim 1, wherein said assistant pulley and said second pulley are rotated by a second belt.

7. The yarn supply apparatus for a textile machine according to claim 6, wherein the diameter of said assistant pulley is less than that of said first pulley.

8. The yarn supply apparatus for a textile machine according to claim 1, wherein said holder body includes an installation part having an upper planar surface.

9. The yarn supply apparatus for a textile machine according to claim 8, wherein the second yarn guiding eyelet is downwardly installed at one end of said holder body.

10. The yarn supply apparatus for a textile machine according to claim 1, wherein said disk part is positioned under said holder body.

11. The yarn supply apparatus for a textile machine according to claim 1, wherein a cross-section of an upper end of said second pulley shaft is a polygon.

12. The yarn supply apparatus for a textile machine according to claim 1, wherein said engagement devices are first and second belt members, respectively.

13. The yarn supply apparatus for a textile machine according to claim 1, wherein said first pulley is rotated by a belt driven by said rotary shaft.

* * * * *